US007380298B2

(12) United States Patent
Hernandez

(10) Patent No.: US 7,380,298 B2
(45) Date of Patent: Jun. 3, 2008

(54) PILLOW DEVICE

(76) Inventor: Cecelia Mary Hernandez, 14185 Springdale St., #4, Westminster, CA (US) 92683

( * ) Notice: Subject to any disclaimer, the term of this patent is extended or adjusted under 35 U.S.C. 154(b) by 0 days.

(21) Appl. No.: 11/517,917

(22) Filed: Sep. 8, 2006

(65) Prior Publication Data

US 2007/0061975 A1 Mar. 22, 2007

Related U.S. Application Data

(60) Provisional application No. 60/714,770, filed on Sep. 8, 2005.

(51) Int. Cl.
*A47G 9/10* (2006.01)

(52) U.S. Cl. ..... 5/639; 5/904

(58) Field of Classification Search ..... 5/639, 5/636, 904, 490; 446/175, 297, 397, 100, 446/321, 337, 391
See application file for complete search history.

(56) References Cited

U.S. PATENT DOCUMENTS

| | | | | | |
|---|---|---|---|---|---|
| 2,199,049 | A | * | 4/1940 | Greenburg | 446/100 |
| 3,159,942 | A | * | 12/1964 | Fiske | 446/302 |
| 4,020,586 | A | * | 5/1977 | Benner | 446/394 |
| 4,309,784 | A | * | 1/1982 | Cohen | 5/639 |
| 4,710,145 | A | * | 12/1987 | Hall Vandis | 446/100 |
| 4,878,871 | A | * | 11/1989 | Noto | 446/302 |
| 5,063,912 | A | * | 11/1991 | Hughes | 601/47 |
| 5,141,466 | A | * | 8/1992 | Catizone | 446/391 |
| 5,279,514 | A | * | 1/1994 | Lacombe et al. | 446/297 |
| 5,357,642 | A | | 10/1994 | Clute | 5/655 |
| 5,403,224 | A | * | 4/1995 | Gintling | 446/321 |
| 5,468,172 | A | * | 11/1995 | Basile | 446/299 |
| 5,515,563 | A | * | 5/1996 | Chao | 5/632 |
| 5,713,741 | A | | 2/1998 | DeMars | 434/319 |
| 5,738,561 | A | * | 4/1998 | Pracas | 446/297 |
| 5,816,885 | A | * | 10/1998 | Goldman et al. | 446/397 |
| 5,842,900 | A | * | 12/1998 | Hodge | 446/73 |
| 5,898,962 | A | * | 5/1999 | McNeal | 5/639 |
| D411,401 | S | * | 6/1999 | Edick et al. | D6/601 |
| 5,947,791 | A | * | 9/1999 | Taylor | 446/321 |
| 6,000,987 | A | * | 12/1999 | Belin et al. | 446/175 |
| 6,146,722 | A | * | 11/2000 | Slawin | 428/13 |
| 6,183,338 | B1 | * | 2/2001 | Mallette | 446/337 |
| 6,196,893 | B1 | * | 3/2001 | Casola et al. | 446/297 |
| 6,236,621 | B1 | | 5/2001 | Schettino | 368/10 |
| 6,447,359 | B1 | * | 9/2002 | Crump | 446/100 |
| 6,669,527 | B2 | * | 12/2003 | Tai Chan | 446/175 |
| 6,692,330 | B1 | * | 2/2004 | Kulick | 446/297 |
| 6,945,841 | B2 | * | 9/2005 | Becker et al. | 446/100 |
| 2007/0061975 | A1 | * | 3/2007 | Hernandez | 5/639 |
| 2007/0254554 | A1 | * | 11/2007 | Ellman et al. | 446/337 |

* cited by examiner

*Primary Examiner*—Robert G. Santos
(74) *Attorney, Agent, or Firm*—James Ray & Assoc.

(57) ABSTRACT

The present invention provides a pillow having a front surface and an opposed rear surface and a chamber formed within the pillow. An audio recording and emitting device is positioned within the chamber for recording and emitting at least one audio message and includes a power source, a speaker coupled to the power source, a microphone coupled to the power source, and a controller coupled to the power source, the speaker and the microphone for at least one of recording and emitting the at least one audio message. A pocket is positioned adjacent an exterior surface of the pillow for receiving at least one of a picture and a document. The pocket has each of an open edge and one of a translucent and a transparent front surface.

14 Claims, 1 Drawing Sheet

PILLOW DEVICE

CROSS-REFERENCE TO RELATED APPLICATIONS

This application is related to and claims priority from Provisional Patent Application Ser. No. 60/714,770 filed Sep. 8, 2005.

FIELD OF THE INVENTION

The present invention relates, in general, to pillows and, more particularly, this invention relates to a pillow having an audio recording and emitting device disposed therein and a pocket for securely receiving a picture.

BACKGROUND OF THE INVENTION

Quite often a child is separated from one or both parents or from other loved ones for an extended period of time. Whether it is due to occupational, vacation, war, adoption and the like conditions, the child is longing to hear parent's voice and to see parent's face particularly during a bedtime routine. As is generally well known, the child and, particularly a small child, is comforted and soothed by the parent's reading or singing and is able to fall asleep quicker and easier.

Yet, generally available daytime communication channels between the child and the parent either by way of the telephone by way of internet are not practical for many reasons when the child is trying to fall asleep.

Furthermore, it has been found that the child desires to keep a picture of the parent(s) or other loved one(s) in close proximity at all times.

U.S. Pat. No. 5,713,741 issued to DeMars discloses a pillow capable of emitting a signal upon the pressure applied by the user's head. A receiver located in a close proximity but remotely from the pillow receives the emitted signal and activates a remotely positioned sound playback device which reproduces a recorded sound. However, this prior art requires the user to transport the receiver and the sound playback device when the user moves to a different environment and is unpractical for use by children and, particularly small children.

U.S. Pat. No. 6,236,621 issued to Schettino teaches a pillow alarm device which includes a pillow having a chamber formed on the front surface thereof and which is provided with a cover flap. The chamber contains an alarm and a sound recording and playback device which is accessible by opening the cover flap. The user is capable of recording a message which is to be played after the alarm has been activated. However, the presence of the flap on the front surface of the pillow is not desirable for use with small children as they may be able to open it and access the sound recording and playback device positioned within the chamber.

U.S. Pat. No. 5,357,642 issued to Clute discloses an infant support pillow with a vibration inducer such as an audio emitter structured to for emitting a generated sound preferably similar to those sounds experienced by the infant when in the womb and thereby promoting sleep. The audio emitter is positioned within an interior chamber which is formed within the pillow and is accessible through a slit formed in the side wall of the pillow. While the interior chamber is hidden from direct view of the child and is therefore advantageous for use with small children, Clute is moot about capabilities to record an audio message.

Furthermore, the available prior art pillows do not allow the child to keep a picture of the parent(s) or other loved one(s) in close proximity to the child.

Therefore, there is a need for an improved pillow having an audio recording and emitting device disposed therein and a pocket for securely receiving a picture.

SUMMARY OF THE INVENTION

According to one embodiment, the invention provides a pillow device which includes a pillow having a front surface and an opposed rear surface. A chamber is formed within an interior portion of the pillow between the front surface and the rear surface. There is means which is positioned within the chamber for recording and emitting at least one audio message. The audio recording and emitting means has a power source, a speaker means which is located adjacent the front surface of the pillow and which is coupled to the power source, a microphone means which is located adjacent the rear surface of the pillow and which is coupled to the power source, and a control means coupled to the power source, the speaker means and the microphone means. The control means is manually operable from a predetermined exterior surface portion of the pillow for at least one of recording and emitting the at least one audio message.

According to another embodiment of the invention, there is provided a pillow device which includes a pillow having a front surface and an opposed rear surface and a chamber formed within the pillow. Means is positioned within the chamber for recording and emitting at least one audio message. This audio recording and emitting means has a power source, a speaker means coupled to the power source, a microphone means coupled to the power source, and a control means coupled to the power source, the speaker means and the microphone means for at least one of recording and emitting the at least one audio message. At least one pocket is positioned adjacent an exterior surface of the pillow for receiving at least one of a picture and a document. Such at least one pocket has each of an open edge and one of a translucent and a transparent front surface.

According to yet another embodiment, the invention provides a method of enabling a user to hear a voice of a loved one. The method includes the steps of providing a pillow having an audio recording and emitting device mounted within a chamber formed within the pillow. Then, recording, by the loved one using the device, at least one audio message. Next, activating, by the user, the device to emit the at least one audio message.

OBJECTS OF THE INVENTION

It is, therefore, one of the primary objects of the present invention to provide a pillow having a device capable of recording and emitting at least one audio message.

Another object of the present invention is to provide a pillow having a device capable of recording and emitting at least one audio message wherein such device is concealed from direct view.

Yet another object of the present invention is to provide a pillow having a device capable of recording and emitting at least one audio message which is activated by a pressure applied by the user's head rested on the pillow.

A further object of the present invention is to provide a pillow having a device capable of recording and emitting at least one audio message which is economical to manufacture.

Yet a further object of the present invention is to provide pillow having in combination a device capable of recording and emitting at least one audio message and a pocket for securely receiving a picture.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
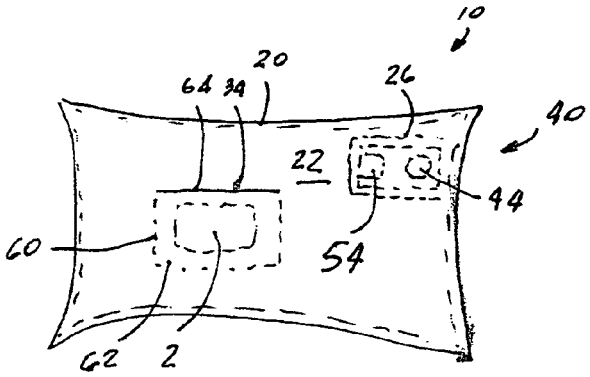
FIG. 1 is a front elevation view of a pillow device of the present invention.
Figure 2:
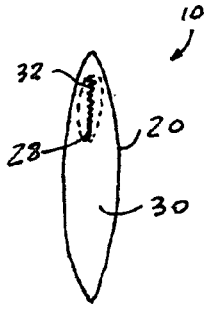
FIG. 2 is a side elevation view of the pillow device of FIG. 1.
Figure 3:
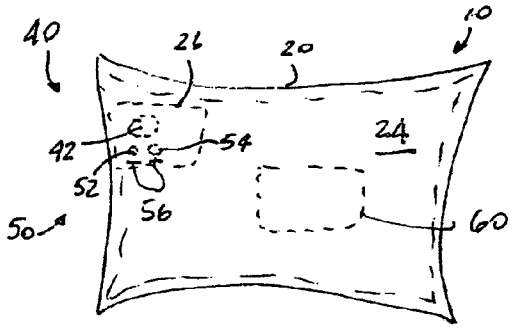
FIG. 3 is a rear elevation view of the pillow device of FIG. 1.

Prior to proceeding to the more detailed description of the present invention, it should be noted that, for the sake of clarity and understanding, identical components which have identical functions have been identified with identical reference numerals throughout the several views illustrated in the drawing figures.

According to a first embodiment of the invention, there is provided a pillow device, generally designated as 10. Now in reference to FIGS. 1-4, such pillow device 10 includes a pillow 20 having a front surface 22 and an opposed rear surface 24. The pillow 20 has each of a predetermined size and a predetermined shape and may be constructed from any well known material presently used in pillow construction.

The pillow 20 further includes a chamber 26 which has a predetermined size and which is formed within an interior portion of the pillow 20 and between the front surface 22 and the rear surface 24. For the reasons to be explained later, the chamber 26 may be accessed through a slit 28 preferably provided in a side wall 30 of the pillow 20 and best shown in FIG. 2. It is further preferred that the pillow 20 further includes means, such as a fastener means 32, for releasably covering the slit 28 which will be advantageous in concealing the chamber 26 from children while enabling easy access by an adult. The presently preferred fastener means 32 is a zipper 32. Although, it will be appreciated that button type or Velcro.RTM type fastener means 32 are suitable for use in the present invention.

The pillow device 10 additionally includes means, generally designated as 40, which is positioned within the chamber 26 for recording and emitting at least one audio message. In further reference to FIG. 4, such audio recording and emitting means 40 includes a microphone means 42 which is preferably located adjacent the front surface 22 of the pillow 20 and a speaker means 44 which may be located adjacent the front surface 22 and is preferably located adjacent the rear surface 24 of the pillow 20. It is to be understood that the definition of the microphone means 42 applies to a microphone device and associated circuitry for recording and storing sound and the definition of the speaker means 44 applies to at least one speaker device and associated circuitry for emitting the recorded sound. It will be further understood that the circuitry for emitting sound and the circuitry for recording and storing sound may be combined into a single circuit 46 which may be either of a solid state or a microprocessor based type.

The audio recording and emitting means 40 further includes a power source, such as battery means 48, and a control means, generally designated as 50, which is manually operable from a predetermined exterior surface portion of the pillow 20 for at least one of recording and emitting the at least one audio message.

The control means 50 includes a first switch means 52 for activating the microphone means 42 and for recording the at least one audio message and a second switch means 54 for activating the speaker means 44 and for emitting the at least one audio message. Both switch means 52 and 54 may be of a simple pushbutton type switch means operated from the rear surface 24 of the pillow 20. A predetermined indicia 56 may be provided on such rear surface 24 to indicate location and function of the first and second switch means 52 and 54 respectively.

It is presently preferred that the second switch 54 is a pressure-sensitive switch 54 positioned in close proximity to the front surface 22 of the pillow 20 and operable by a pressure applied by the user's head.

An optional timer means 58 may be provided for terminating emission of the at least one audio message after expiration of a predetermined period of time. The timer means 58 may be of an adjustable type to suit a particular child or a particular age group.

In operation, the loved one such as a parent, grandparent, relative and the like simply activates the microphone means 42 by way of the first control switch 52 and speaks thereinto to record such at least one audio message. The at least one audio message may be also in a form of a song. The child than uses the second switch means 54 to activate the speaker means 44 to receive such recorded at least one audio message and be comforted and soothed by the voice of the loved one while falling asleep. It will be appreciated that when the second switch 54 is activated by a pressure applied by the child's head rested on such pillow 20, the pillow device 10 is suitable for use with small children who lack physical ability to manually operate such switch means 54 being of a pushbutton or rocker type. The timer means 58 is advantageous in terminating the emission when child is asleep.

Positioning of the first control means 52 and the microphone means 42 in close proximity to the rear surface 24 in combination with a power source 48 having a long life is advantageous in eliminating the need for the user to remove the audio recording and emitting means 40 from the chamber 26 in order to record such at least one audio message. Thus, the audio recording and emitting means 40 will be installed during manufacturing of the pillow 20. Accordingly, the chamber 26 and the audio recording and emitting means 40 are concealed from the direct view of the user.

Obviously, the accessible nature of the chamber 26 enables the parent(s) or the loved one(s) provide at least one additional audio recording and emitting means 40 having a different audio message and which can be easily inserted into the chamber 26 by an adult after removing the existing audio recording and emitting means 40. Accordingly, the child will be able to hear a new audio message.

According to another embodiment, the present invention contemplates at least one pocket 60 which is positioned adjacent a second predetermined exterior surface portion of the pillow which is preferably the front surface 22. The at least one pocket 60 has one of a translucent and transparent front surface 62 and an open edge 64 for receiving at least one of a picture and a document 2.

In further reference to FIG. 1, the at least translucent front surface 62 of the at least one pocket 60 is formed integrally with the front surface 22 of the pillow 20 and the open edge 64 is accessible through a slit 34 formed in the front surface 22 of the pillow 20.

Figure 5:
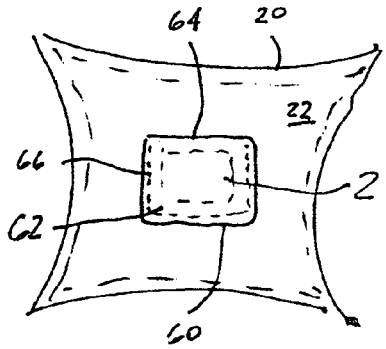
FIG. 5 is a front elevation view of the pillow device of the present invention, particularly illustrating an alternative construction of a pocket for storing a picture.
Figure 4:
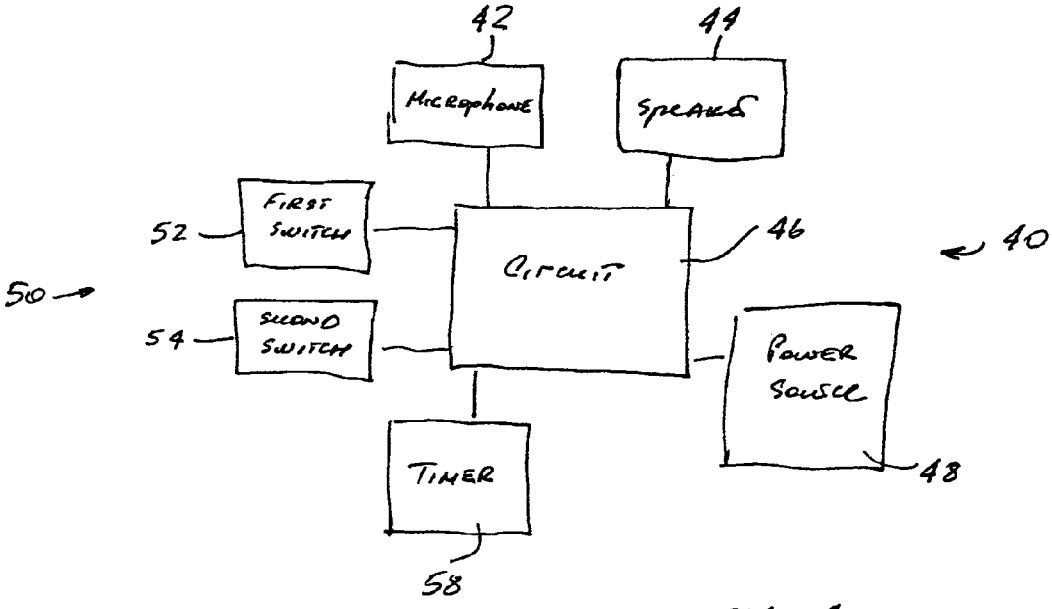
FIG. 4 is a block diagram of the pillow device of FIG. 1.

Alternatively, as best shown in FIG. 5, the at least one pocket 60 may be externally attached to the front surface 22 by way of stitches 66 or adhesive (not shown).

Presence of the at least one pocket 60 will enable the child to look at the picture 2 of the loved one(s) while rasting his or her head on the pillow 20 and be soothed and comforted by such picture 2.

It will be appreciated that an older child capable of reading text may elect to keep a letter from the loved one(s) in such at least one pocket 60 and easily remove it to be read.

Although, the present invention has been illustrated in terms of the chamber 26 formed internal to the pillow 20, it will be apparent to those skilled in the art that an open chamber may be formed adjacent one surface of the pillow 20 and provided with a flap for selectively closing and opening such open chamber.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A pillow device comprising:

(a) a pillow having a front surface and an opposed rear surface;

(b) a chamber formed within an interior portion of said pillow between said front surface and said rear surface; and (c) means positioned within said chamber for recording and emitting at least one audio message, said audio recording and emitting means having a power source, a speaker located proximal to said front surface and distal from said rear surface of said pillow and coupled to said power source, a microphone located proximal to said rear surface and distal from said front surface of said pillow and coupled to said power source, and a control means coupled to said power source, said speaker and said microphone, said control means manually operable from a predetermined exterior surface portion of said pillow for at least one of recording and emitting said at least one audio message.

2. The pillow device, according to claim 1, wherein said chamber is accessible through a slit provided in a side wall of said pillow.

3. The pillow device, according to claim 2, wherein said pillow further includes means for selectively opening and closing said slit.

4. The pillow device, according to claim 1, wherein said control means is operable from said rear surface of said pillow.

5. The pillow device, according to claim 1, wherein said control means includes a circuit means coupled to said microphone for storing said at least one audio message and coupled to said speaker for emitting said at least one audio message, a first switch means for activating said microphone and for recording said at least one audio message, and a second switch means for activating said speaker and for emitting said at least one audio message.

6. The pillow device, according to claim 5, wherein said second switch means is a pressure-sensitive switch positioned in close proximity to said front surface of said pillow and operable by a pressure applied by a user's head rested on said pillow.

7. The pillow device, according to claim 5, wherein said control means further includes a timer means for terminating emission of said at least one audio message after expiration of a predetermined period of time.

8. The pillow device, according to claim 1, wherein said pillow device includes at least one pocket for receiving at least one of a picture and a document, said at least one pocket having each of an open edge and one of a translucent and a transparent front surface.

9. The pillow device, according to claim 8, wherein said at least one pocket is disposed within said pillow and adjacent a second predetermined exterior surface portion thereof.

10. The pillow device, according to claim 9, wherein said second predetermined exterior surface portion is said front surface of said pillow and said front surface of said at least one pocket is formed integral with said front surface of said pillow and said open edge is accessible through a slit formed in said front surface of said pillow.

11. The pillow device, according to claim 8, wherein said at least one pocket is externally attached to a predetermined surface of said pillow.

12. A pillow device comprising:

(a) a pillow having a front surface and an opposed rear surface;

(b) a chamber formed within said pillow;

(c) means positioned within said chamber for recording and emitting at least one audio message, said audio recording and emitting means having a power source, a speaker located proximal to said front surface and distal from said rear surface of said pillow and coupled to said power source, a microphone located proximal to said rear surface and distal from said front surface of said pillow and coupled to said power source, and a control means coupled to said power source, said speaker and said microphone for at least one of recording and emitting said at least one audio message; and (d) at least one pocket positioned adjacent an exterior surface of said pillow, said at least one pocket for receiving at least one of a picture and a document, said at least one pocket having each of an open edge and one of a translucent and a transparent front surface.

13. A method of enabling a user to hear a voice of a loved one, said method comprising the steps of:

(a) providing a pillow having an audio recording device mounted within a chamber formed within said pillow and proximal to a rear surface and distal from a front surface thereof and an audio emitting device mounted within said chamber formed within said pillow and proximal to said front surface and distal from said rear surface thereof;

(b) recording, by said loved one using said device, at least one audio message; and (c) activating, by said user, said device to emit said at least one audio message.

14. The method, according to claim 13, wherein said method includes the step of providing at least one pocket positioned adjacent an exterior surface of said pillow for securely receiving at least one of a picture and a document.

* * * * *